US006264123B1

(12) United States Patent
Clark

(10) Patent No.: US 6,264,123 B1
(45) Date of Patent: Jul. 24, 2001

(54) WASTE DISPOSER INCORPORATING ROTATABLY COUPLED HOUSINGS

(76) Inventor: Brandon Beaumont Clark, 257 Barbara Dr., Los Gatos, CA (US) 95032

( * ) Notice: Subject to any disclaimer, the term of this patent is extended or adjusted under 35 U.S.C. 154(b) by 0 days.

(21) Appl. No.: 09/457,905

(22) Filed: Dec. 8, 1999

(51) Int. Cl.[7] ..... B02C 18/42
(52) U.S. Cl. ..... 241/46.014
(58) Field of Search ..... 241/46.04, 46.013–46.017, 241/285.1

(56) References Cited

U.S. PATENT DOCUMENTS 3,862,720 * 1/1975 Guth ..... 241/100.5
3,873,036 * 3/1975 Smith ..... 241/100.5
4,082,229 * 4/1978 Boosman .
4,135,258 * 1/1979 Braga et al. ..... 241/100.5
5,308,000 5/1994 Riley .

* cited by examiner

*Primary Examiner*—Mark Rosenbaum

(57) ABSTRACT

A waste disposer having a food chamber and a motor housing that are rotatably coupled together is provided. A clamp couples the food chamber to the motor housing. When the clamp is closed, the clamp causes an open end of the housing to exert pressure on a flange of the food chamber to form a friction-fit between the housing and food chamber. The open end of the housing exerts enough pressure on the flange to prevent leaks between the housing and food chamber. In an open position, the clamp allows relative rotation between the food chamber and motor housing. When the clamp is open, the pressure that the open end exerts on the flange is released to allow rotation therebetween. The configuration of clamp retains the flange in contact with the open end, to inhibit food particles and other matter from lodging between the flange and open end.

16 Claims, 3 Drawing Sheets

WASTE DISPOSER INCORPORATING ROTATABLY COUPLED HOUSINGS

BACKGROUND OF THE INVENTION

1. Field of the Invention

The present invention relates generally to waste disposer devices, and more particularly, to an improved waste disposer having a food chamber and motor housing that are rotatably coupled together.

2. Description of Related Art

Garbage or waste disposers are well known in the prior art and are common in both commercial and household applications. Waste disposers are interposed between a drain of a sink and an outlet conduit connected to a sewer system. Waste disposers are used to grind food waste matter and similar debris into small particles, to prevent the food matter from clogging the outlet conduit of the sewer system.

A waste disposer is coupled to a drain opening of a sink and to outlet conduit connected to the sewer system. The waste disposer comprises a food chamber fastened to a motor housing. Within the motor housing is an electric motor that is connected to a power source and a grind assembly positioned above the motor and coupled thereto. The grind assembly includes a grind plate coupled to the motor. The grind assembly also includes grind blades rotatably secured to the grind plate and an outlet aperture in a sidewall of the housing. The outlet aperture is interposed between a bottom surface of the grind plate and the motor. Ground food particles are flushed through small openings in the grind plate and into the outlet aperture. An outlet pipe is coupled to the outlet aperture for coupling the waste disposer to outlet conduit, to allow the ground food particles to be flushed into the sewer system.

The food chamber is fastened to the open end of the motor housing to prevent leaks from forming between the chamber and housing. A plurality of spatially positioned channels extend from a bottom plate of the motor housing toward the open end thereof and adjacent to the sidewall. Elongated bolts are disposed in the channels and extend through the channels and along the sidewall of the grind assembly portion of the housing.

The food chamber is configured with a flange that extends about a bottom edge thereof. Holes that mate with the channels are provided in the flange. The food chamber's flange is positioned over the open end of the motor housing and ends of the bolts are disposed through each of the holes in the flange. A nut is then threaded onto the end of each bolt and tightened, until the food chamber is securely fastened to the motor housing.

The food chamber also has an inlet opening that mates with the drain opening of the sink. A flange mechanism is coupled to the food chamber's inlet opening for securing the waste disposer to the sink. The food chamber also includes a dishwasher inflow tube that provides a drain path to the sewer system for waste water from an automatic dishwasher. Waste water from the dishwasher flows through the inflow tube, into the food chamber, and out through the outlet aperture into the outlet conduit connected thereto. The inflow tube is aligned with the outlet aperture in the motor housing.

The waste disposer is installed by first positioning the inlet opening of the food chamber adjacent to the drain opening of the sink. The flange mechanism is used to secure the inlet opening of the food chamber, and thus secure the disposer to the sink. Prior to fully tightening the waste disposer against the sink, the disposer may be rotated to align the outlet aperture with outlet conduit of the sewer system. Once the desired position is achieved, the inlet opening of the food chamber is tightened against the sink to prevent the disposer from moving about beneath the sink and to prevent leaks. The outlet conduit is then coupled to the outlet aperture.

Outflow tubing from the dishwasher is then coupled to the inflow tube of the food chamber. However, since the inflow tube is aligned with the outlet aperture in the motor housing, outlet conduit coupled to the outlet aperture usually obstructs access to the inflow tube, making it difficult to couple the dishwasher's outflow tubing to the inflow tube. Further, there may be additional outlet conduit, such as outlet conduit coupled to a drain of a partitioned sink for example, and other obstructions beneath the sink that render coupling of the dishwasher's outflow tubing to the inflow tube somewhat difficult.

Thus, there exists a need for an improved waste disposer that is easier and faster to install than prior designs.

SUMMARY OF THE INVENTION

The present invention comprises an improved food waste disposer comprising a food chamber and a motor housing that are rotatably coupled together in facilitate installation. In a preferred embodiment, a clamp is used to couple the food chamber to the motor housing. When the clamp is in a closed position, the clamp causes an open end of the housing to exert sufficient pressure on a flange of the food chamber to prevent leaks from forming therebetween and to limit inadvertent relative movement between the housing and food chamber. Therefore, the clamp of the present invention obviates the need for fastening the housing to the food chamber by other means, such as with bolts, as was common to the prior art.

In an open position, the clamp allows the food chamber and motor housing to be rotated relative to one another to facilitate installation of the waste disposer. When the clamp is open, the pressure that the housing's open end exerts on the food chamber's flange is reduced sufficiently to allow rotation. However, the clamp is configured to retain the flange in contact with the open end, to inhibit food particles and other matter from lodging between the flange and open end, which may result in leaks. Additionally, the clamp prevents the motor housing from completely detaching from the food chamber, which could cause damage to the housing, chamber, or both.

By way of example, prior to installation, the compression clamp is placed in the open position to enable rotation of the food chamber relative to the housing. An inlet opening of the food chamber is first coupled to a drain opening of a sink. The motor housing may then be rotated to align an outlet aperture in the housing with outlet conduit of a sewer system located beneath the sink, for connecting the disposer to the outlet conduit. The food chamber may then be rotated to align the inflow tube thereof with outflow tubing that is connected to an automatic dishwasher, for example. The outlet conduit is then connected to the outlet aperture and the outflow tubing is connected to the inflow tube. The inlet opening of the food chamber is then secured to the drain opening, to secure the disposer to the sink. The clamp is placed in the closed position to prevent the disposer from leaking and to limit any further movement between the housing and food chamber.

Alternatively, once the food chamber is coupled to the drain opening of the sink, the chamber can be rotated to align the inflow tube with the outflow tubing, prior to aligning the housing with the outlet conduit located beneath the sink. Once a desired position of the food chamber is achieved, the housing may be rotated to align the outlet aperture of the housing with the outlet conduit. Similarly, both the housing and food chamber can be rotated simultaneously during installation.

Therefore, the waste disposer of the present invention facilitates installation thereof. Rotation of the food chamber and motor housing relative to one another aids in aligning the housing's outlet aperture with the outlet conduit of the sewer system and in aligning the chamber's the inflow tube with the outflow tubing of the dishwasher. Further, rotation of the chamber and housing relative to one another may allow unobstructed access thereto during connection of conduit to either the chamber or housing. This may reduce the time required to install the disposer.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes presently contemplated by the inventor of carrying out the invention. Various modifications, however, will remain readily apparent to those skilled in the art, since the generic principles of the present invention have been defined herein.

Figure 1:
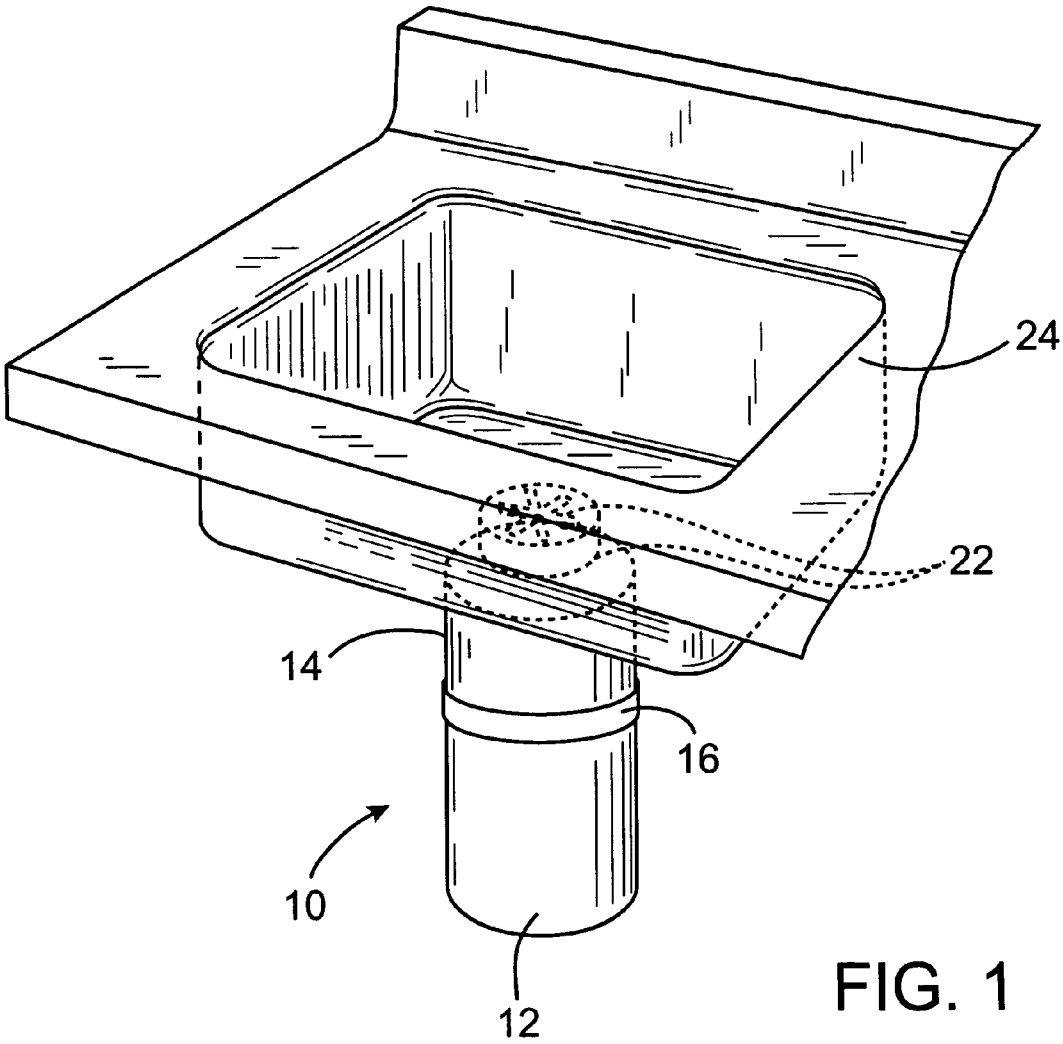
FIG. 1 is a perspective view showing a preferred embodiment of an improved food waste disposer of the present invention coupled to a drain of a sink partially shown in phantom.
Figure 2:
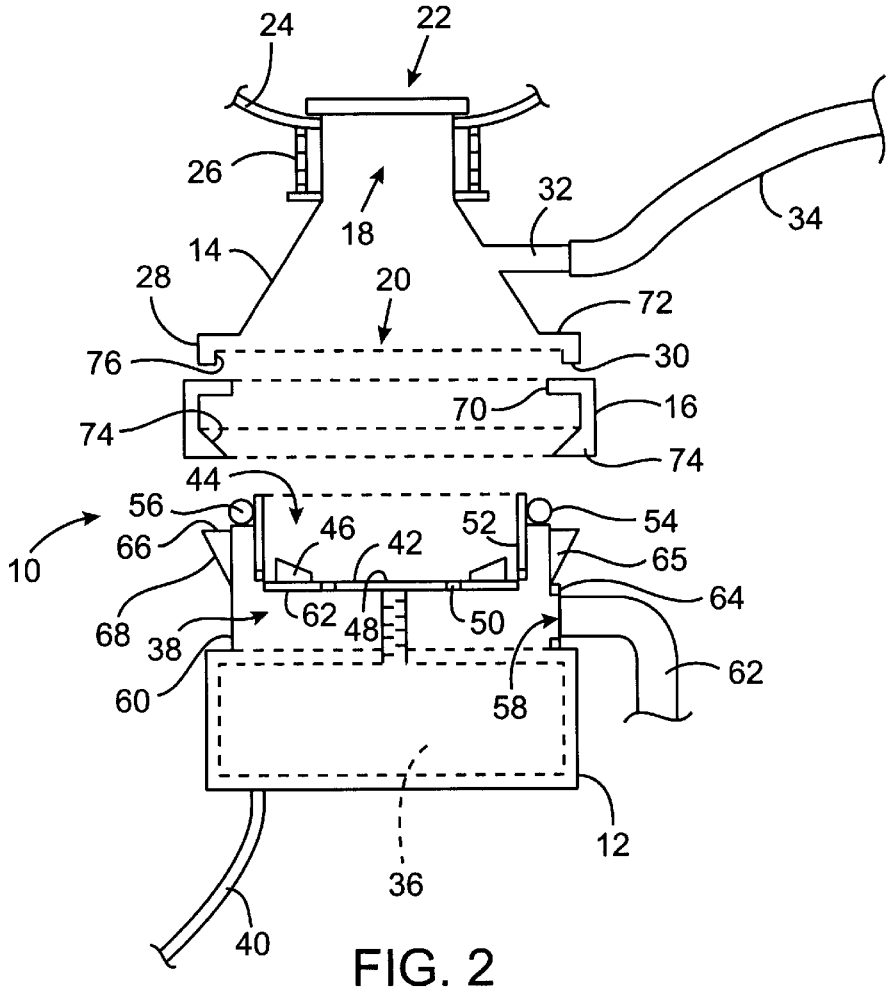
FIG. 2 is a cross sectional exploded view of the preferred embodiment.

Referring now to FIG. 1 and FIG. 2 of the drawings, there is shown generally at 10, a preferred embodiment of a food waste disposer constructed according to the principles of the present invention. The waste disposer 10 comprises a motor housing 12 coupled to a food chamber 14 with a compression clamp 16. The compression clamp 16 of the invention couples the housing 12 to the food chamber 14 with sufficient force to prevent leaks between the housing 12 and chamber 14 and inhibit inadvertent relative movement between the housing 12 and chamber 14. The clamp 16 also enables the housing 12 and food chamber 14 to rotate relative to each other to facilitate installation thereof. The clamp 16 of the invention obviates the need for fastening the housing 12 to the food chamber 14 by other means, such as bolts, as was common in the prior art.

The food chamber 14 comprises a hollow chamber having an inlet end 18 and an outlet end 20. The inlet end 18 is preferably dimensioned to mate with a drain opening 22 of a sink 24 and the outlet end 20 is configured to couple the chamber 14 to the housing 12. The inlet end 18 may be provided with a well known interlocking flange mechanism 26 for securing the disposer to the sink's drain opening 22. The outlet end 18 has a flange 28 extending about its periphery. The flange 28 has a downwardly extending end portion 30 that aids with positioning the chamber 14 on the motor housing 12.

The food chamber 14 also includes an inflow tube 32. The inflow tube 32 connects to outflow tubing 34 that may be connected to an automatic dishwasher (not shown). The food chamber 14 is fabricated using well known materials, such as suitable polymeric materials, and methods known in the art.

The motor housing 12 is provided to retain or house a known electric motor 36 and a grind assembly 38 positioned above the motor 36 and connected thereto. The motor 36 may comprise any suitable known electric motor with a power output of preferably about ⅓ or ½ horsepower. A power cord 40 is provided for connecting the motor 36 to a suitable power source (not shown).

The grind assembly 38 includes a grind plate 42 that is inset from an open top end 44 of the housing 12. A pair of grind blades 46 are rotatably mounted on a top side 48 of the grind plate 42. A plurality of small holes 50 extend through the plate 42 to allow small ground food particles to pass through the plate 42.

The grind assembly 38 further includes a cylindrical grind sleeve 52 that extends slightly above the open end 44 of the housing 12 to form a shoulder 54. A resilient O-ring 56 is configured to extend about the open end 44 of the housing 12 and reside in the shoulder 54. The O-ring 56 provides a seal between the food chamber's flange 28 and housing's open end 44 to prevent leaks between the food chamber 14 and housing 12. The O-ring 56 also has a relatively low coefficient of static friction that aids with rotating the housing 12 and food chamber 14 relative to one another. The O-ring 56 may be any suitable commercially available resilient O-ring and comprise rubber or any appropriate polymeric material. In alternate embodiments, housings open end 44 may seal directly against the flange 28 without the need for an O-ring.

An outlet aperture 58 is formed though a sidewall 60 of the grind assembly portion of the housing 12. The aperture 58 is interposed between a bottom side 62 of the grind plate 42 and the motor 36. A portion of outlet conduit 62 may be attached to a mounting bracket 65 that is made integral on the sidewall 60 and extends about periphery of the aperture 58, for coupling the waste disposer 10 to a sewer system (not shown). As food waste matter (not shown) is ground by the grind assembly 38, small food particles and water pass though the holes 50 in the grind plate 42 and between the plate 42 and grind sleeve 52, out through the outlet aperture 58 and into the outlet conduit 62 for conveyance to the sewer system.

In a preferred embodiment A plurality of tabs 64 are positioned about the periphery of the housing 12 adjacent to the open end 44 thereof. Preferably, the tabs 64 have a flat top side 66 and outwardly inclined sidewalls 68. The flat top side 66 of the tabs 64 mates with a bottom edge 70 of the downwardly extending end 30 of the flange 28. The inclined sidewalls 68 of the tabs 64 are configured to mate with a portion of the compression clamp 16 (more thoroughly discussed hereinafter), to aid with coupling the housing 12 to the food chamber.

Figure 3:
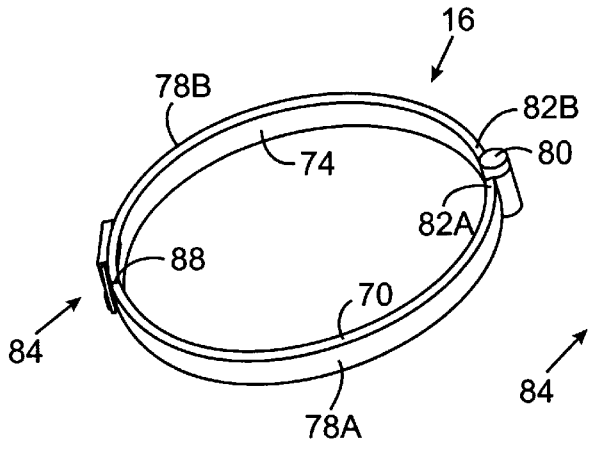
FIG. 3 is a perspective view showing a compression clamp of the present invention in a closed position.
Figure 4:
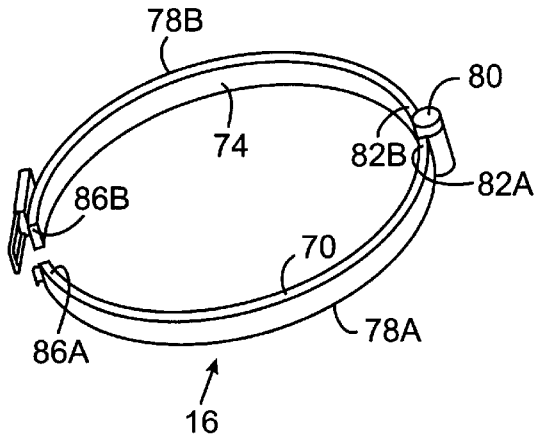
FIG. 4 is a perspective view showing the compression clamp of the present invention in an open position.

Referring still to FIGS. 2–4, the compression clamp 16 of the present invention is dimensioned to extend about the periphery of the open end 44 of the housing 12 and outlet end 20 of the food chamber 14, for coupling the chamber 14 to the housing 12. The clamp 16 preferably comprises an annular clamp that has a generally C-shaped cross sectional configuration. In the preferred embodiment, the clamp 16 has a flat upper lip 70 that mates with a planer upper side 72 of the flange 28. The clamp's upper lip 70 is sized to extend at least partially over the flange's upper side 72. A lower lip 74 of the clamp 16 is inclined for drawing the housing 12 toward the food chamber 16. The inclined lower lip 74 is configured to mate with the inclined sidewalls 68 of the tabs 64 to draw the housing's open end 44 tightly against a bottom wall 76 of the flange 28, when the clamp 16 is in a closed position.

In one embodiment, the clamp 16 may comprise a first section 78A and a second section 78B that are pivotally coupled together so that the clamp 16 can be adjusted between the open position (shown in FIG. 4) and closed position (shown in FIG. 3). A hinge 80, or other appropriate means, is integrally formed at one end 82A, 82B of each section 78A, 78B of the clamp 16. The hinge 80 enables the first and second sections 78A, 78B to be pivoted outwardly relative to each other for opening the clamp 16 (open position) and pivoted toward each other for closing the clamp 16 (closed position). In alternate embodiments, the clamp 16 may not include a hinge 80, and may instead be sufficiently flexible so as to deform somewhat to adjust between an open and a closed position.

A buckle device 84 may be integrally formed at a second end 86A, 86B of each section 78A, 78B of the clamp 16 to retain the clamp 16 in the closed position. The buckle 84 may be configured with a retaining strap 88, or other retaining device, to limit the outward movement of the sections 78A, 78B relative to each other. The retaining strap 88 seen in FIG. 3 prevents the clamp 16 from completely detaching from the disposer 10 when the clamp 16 is opened. The strap 88 may be fabricated of any practical material.

Figure 5:
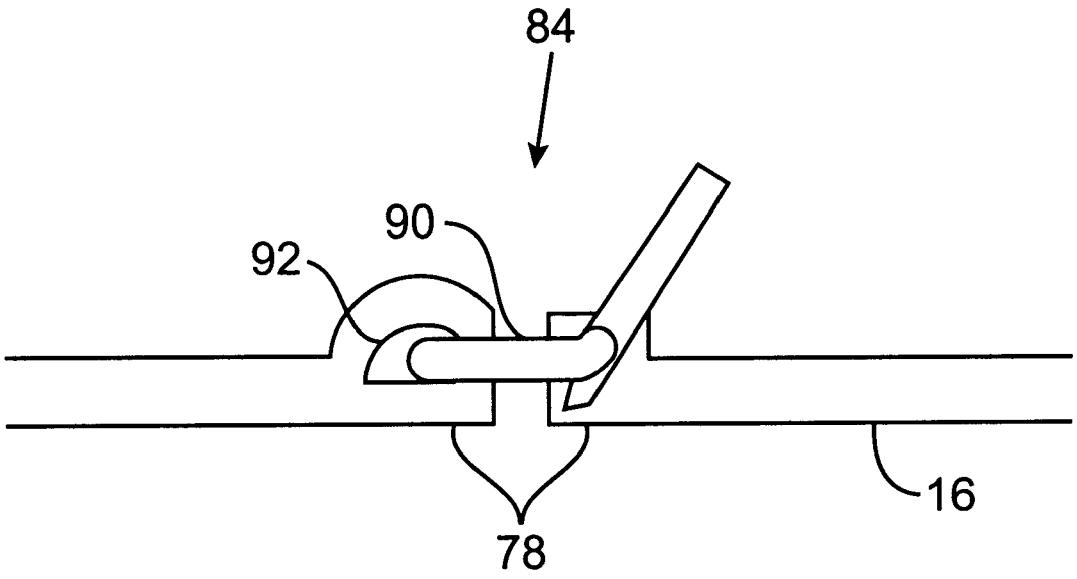
FIG. 5 is a side view of an embodiment of a buckle on the compression clamp.

It is preferred that the configuration of the clamp 16 causes the O-ring 56 to stay in contact with the flange's bottom wall 76 so that no food particles or other debris become lodged between the food chamber 14 and housing 12. This prevents leaks between the chamber 14 and housing 12 caused by foreign material interfering with the seal between the housings open end 44 and the flange 28. Another reason to prevent the housings open end 44 and the flange 28 from completely separating is to prevent tampering with the blades of the grind assembly 38, which may be dangerous if done while the electricity to the disposer 10 is on. FIG. 5 shows standard lever buckle 84 on one end of the compression clamp 16 coupled to the other end of the compression clamp 16 by a link 90 held in link aperture 92 formed on the opposite end of the compression clamp 16. This embodiment allows the compression clamp 16 to open a maximum selected distance limited by the configuration of the buckle 84. This preferably allows the housing 12 to be rotated relative to food chamber 14, but prevents the clamp ends from separating enough to allow a gap to form between the housing 12 and the food chamber 14, into which foreign matter may enter. Alternatively, no retaining device may be provided if it is desired to completely remove the clamp 16 from the disposer 10 when the clamp 16 is open.

Thus, the clamp 16 of the disposer 10 of the present invention enables rotation of the housing 12 relative to the food chamber 14 to facilitate installation thereof. By way of example, the buckle 84 is opened to enable the first and second sections 78A, 78B to pivot outwardly from each other for opening the clamp 16 and enabling rotation of the housing 12 and food chamber is 14 relative to each other. The interlocking flange mechanism 26, coupled to the food chamber's inlet end 18, is used to secure the disposer 10 to the sink's drain opening 22. The motor housing 12 may then be rotated to align the outlet aperture 58 with outlet conduit located beneath the sink 24.

The food chamber 14 can also be rotated to align the inflow tube 32 with outflow tubing 34, for connecting the tubing 34 to the food chamber 14. Once the desired alignments are achieved, the outflow tubing 34 is coupled to the inflow tube 32 and the outlet conduit 62 is coupled to the outlet aperture 58 using know methods. The buckle 84 is then rotated closed to draw the ends 86A, 86B of the clamp 16 together to close the clamp 16.

As the first and second sections 78A, 78B are drawn toward each other, the clamp's inclined lower lip 74 contacts the inclined sidewalls 68 of the tabs 64. The lower lip 74 draws the housing's open end 44 upward against the bottom wall 76 of the flange 28. The grind sleeve 52 extends slightly into the food chambers' outlet end 18 and the O-ring 56 residing in the shoulder 54 contacts the bottom wall 28. Once the buckle 84 is fully closed, the shoulder 54 is forced tightly against the flange's bottom wall 76, causing the O-ring 56 to be sufficiently deflected to form a seal between open end's 44 shoulder 54 and flange's the bottom wall 76. Thus, leaks between the food chamber 14 and housing 12 are prevented and inadvertent relative movement therebetween is limited.

Therefore, the waste disposer of the present invention facilitates installation, possibly allowing a faster installation. Rotation of the food chamber and motor housing relative to one another aids in aligning the housing's outlet aperture with the outlet conduit of the sewer system and in aligning the chamber's the inflow tube with the outflow tubing of the dishwasher. The need for the outflow tube to make a big sweep in the prior art to prevent the outflow tube becoming kinked is avoided. This makes it easier to prevent the outflow tube from dropping below the natural drain level, thus trapping water in the outflow tube.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A waste disposer comprising:

a motor housing having an open top end;

a food chamber having an outlet end;

a clamp configured to extend about the open end of the motor housing and the outlet end of the food chamber, the clamp adjustable between an open position and a closed position, the clamp causing the open end of the housing to exert pressure on the outlet end of the food chamber to inhibit leaks between the top end of the housing and outlet end of the food chamber, when the clamp is in the closed position; and a resilient o-ring extending about the periphery of a shoulder of a rim of the housing and interposed between the rim and a flange of the open end of the housing, the o-ring providing a low coefficient of static friction contact between the housing and the food chamber when the clamp is in the open position to enable rotation therebetween, and providing a deflectable seal between the rim and a bottom surface of the flange to inhibit leaks therebetween when the clamp is in the closed position.

2. The disposer of claim 1 wherein the food chamber and motor housing are rotatable relative to one another when the clamp is in the open position.

3. The disposer of claim 2 wherein the clamp is configured to retain the outlet end of the food chamber in contact with the open end of the motor housing when the clamp is in the open position.

4. The disposer of claim 1 wherein the clamp is detachable from the disposer.

5. A food waste disposer comprising:

a cylindrical motor housing having an open top end, the housing retaining a motor and a grind assembly, the grind assembly coupled to the motor and inset from the open end of the housing, the housing provided with a plurality of tabs located adjacent to a rim of the open end;

a hollow food chamber having an inlet end and an outlet end, the outlet end dimensioned to mate with the open end of the housing, the outlet end configured with a flange that extends over the rim of the open end of the housing when the food chamber is positioned on the open end;

a clamp extending about both the outlet end of the food chamber and open end of the housing, the clamp adjustable between an open position and a closed position, the clamp configured to extend over at least a portion of the flange of the food chamber and over at least a portion of the tabs adjacent to the rim of the housing for causing the rim to exert pressure on the flange to inhibit leaks between the housing and food chamber, when the clamp is in the closed position; and a resilient o-ring extending about the periphery of a shoulder of the rim of the housing and interposed between the rim and flange, the o-ring providing a low coefficient of static friction contact between the housing and the food chamber when the clamp is in the open position to enable rotation therebetween, and providing a deflectable seal between the rim and the bottom surface of the flange to inhibit leaks therebetween when the clamp is in the closed position.

6. The disposer of claim 5 wherein the food chamber and motor housing are rotatable relative to one another when the clamp is in the open position.

7. The disposer of claim 6 wherein the clamp is configured to retain the flange of the food chamber in contact with the rim of the housing when the clamp is in the open position.

8. The disposer of claim 5 wherein the clamp is configured with a generally C-shaped cross sectional configuration, the clamp having an upper lip configured to extend over at least a portion of the flange of the food chamber and a lower lip configured to extend over at least a portion of the tabs adjacent to the rim of the housing, the lower lip configured to draw the rim and flange together so that the rim exerts sufficient pressure on the flange to inhibit leaks therebetween.

9. The disposer of claim 8 wherein each of the tabs has an outwardly inclined sidewall and the lower lip of the clamp is inclined to mate with the inclined sidewall of each tab, the inclined lower lip of the clamp and inclined sidewall of each tab coacting to draw the rim of the housing toward a bottom surface of the flange, until the rim exerts sufficient pressure on the bottom surface to inhibit leaks therebetween.

10. The disposer of claim 5 wherein the clamp is detachable from the disposer to allow the food chamber to completely detach from the motor housing.

11. A food waste disposer comprising:

a cylindrical motor housing having an open top end, the housing retaining a motor and a grind assembly, the grind assembly coupled to the motor and inset from the open end of the housing, the housing provided with a plurality of tabs located adjacent to a rim of the open end;

a hollow food chamber having an inlet end and an outlet end, the outlet end dimensioned to mate with the open end of the housing, the outlet end configured with a flange that extends over the rim of the open end of the housing when the food chamber is positioned on the open end; and a clamp extending about both the outlet end of the food chamber and open end of the housing, the clamp adjustable between an open position and a closed position, the clamp configured to extend over at least a portion of the flange of the food chamber and over at least a portion of the tabs adjacent to the rim of the housing for causing the rim to exert pressure on the flange to inhibit leaks between the housing and food chamber, when the clamp is in the closed position, wherein each of the tabs has an outwardly inclined sidewall and a lower lip of the clamp is inclined to mate with the inclined sidewall of each tab, the inclined lower lip of the clamp and inclined sidewall of each tab coacting to draw the rim of the housing toward a bottom surface of the flange, until the rim exerts sufficient pressure on the bottom surface to inhibit leaks therebetween.

12. The disposer of claim 11 wherein the food chamber and motor housing are rotatable relative to one another when the clamp is in the open position.

13. The disposer of claim 12 wherein the clamp is configured to retain the flange of the food chamber in contact with the rim of the housing when the clamp is in the open position.

14. The disposer of claim 11 wherein the clamp is configured with a generally C-shaped cross sectional configuration, the clamp having an upper lip configured to extend over at least a portion of the flange of the food chamber and the lower lip configured to extend over at least a portion of the tabs adjacent to the rim of the housing, the lower lip configured to draw the rim and flange together so that the rim exerts sufficient pressure on the flange to inhibit leaks therebetween.

15. The disposer of claim 14 further comprising a resilient o-ring extending about the periphery of a shoulder of the rim of the housing and interposed between the rim and flange, the o-ring providing a low coefficient of static friction contact between the housing and the food chamber when the clamp is in the open position to enable rotation therebetween, and providing a deflectable seal between the rim and the bottom surface of the flange to inhibit leaks therebetween when the clamp is in the closed position.

16. The disposer of claim 11 wherein the clamp is detachable from the disposer to allow the food chamber to completely detach from the motor housing.

* * * * *